US007942692B2

(12) United States Patent
Bodenmeier

(10) Patent No.: US 7,942,692 B2
(45) Date of Patent: May 17, 2011

(54) CONNECTING ELEMENT FOR THE CONNECTION OF SWITCHING DEVICES

(75) Inventor: Martin Bodenmeier, Parkstein (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/450,282

(22) PCT Filed: Sep. 3, 2007

(86) PCT No.: PCT/EP2007/007684
§ 371 (c)(1),
(2), (4) Date: Sep. 18, 2009

(87) PCT Pub. No.: WO2008/113397
PCT Pub. Date: Sep. 25, 2008

(65) Prior Publication Data

US 2010/0081343 A1 Apr. 1, 2010

(30) Foreign Application Priority Data

Mar. 20, 2007 (WO) ..... PCT/EP2007/002459

(51) Int. Cl.
*H01R 31/08* (2006.01)

(52) U.S. Cl. ..... 439/511

(58) Field of Classification Search ..... 439/511, 439/507–510, 512, 513
See application file for complete search history.

(56) References Cited

U.S. PATENT DOCUMENTS 2,470,066 A * 5/1949 Calabrese ..... 174/152 R
4,913,663 A * 4/1990 Siemon et al. ..... 439/509
5,094,626 A * 3/1992 Fabrizi et al. ..... 439/511
5,629,831 A * 5/1997 Eggert et al. ..... 361/624
5,669,788 A * 9/1997 Brockman ..... 439/511
6,299,484 B2 * 10/2001 Van Woensel ..... 439/607.07
6,327,140 B1 * 12/2001 Hashizawa et al. ..... 361/642
6,358,085 B1 * 3/2002 Wislinski et al. ..... 439/509
6,452,785 B1 * 9/2002 Kaaden et al. ..... 361/622
6,663,441 B1 * 12/2003 Alexandre et al. ..... 439/715

(Continued)

FOREIGN PATENT DOCUMENTS

DE 10224976 A1 1/2004

(Continued)

OTHER PUBLICATIONS

Moeller GmbH, Hein-Moeller-Str. 7-11, D-53115 Bonn; Produktinformation "Leistungsschütze DIL M—Motorschutzschalter PKZ—Motorstarter MSC"; Start: effiziente Lösungen für den Motorabgang; Bonn; Others; 2005; DE.

*Primary Examiner* — T C Patel
*Assistant Examiner* — Harshad C Patel
(74) *Attorney, Agent, or Firm* — Harness, Dickey & Pierce, P.L.C.

(57) ABSTRACT

A connecting element is disclosed for the connection of at least two switching devices and a switching device and an electric distribution system. In order to allow for the rapid and wireless connection of a plurality of electromechanical devices, at least one embodiment of the invention proposes a connecting device for the connection of at least two switching devices, wherein the connecting element includes first element(s) for mechanically connecting the switching devices to one and another and second element(s) for electrically connecting switching poles of the switching devices. The second element(s) include flexible connecting elements for connecting the switching devices to the switching poles that are electrically connected to the connecting device.

16 Claims, 8 Drawing Sheets

U.S. PATENT DOCUMENTS

| | | | | |
|---|---|---|---|---|
| 6,851,985 | B2 * | 2/2005 | Lafragette et al. | 439/701 |
| 6,888,077 | B2 * | 5/2005 | Garcia et al. | 200/50.32 |
| 7,173,809 | B2 * | 2/2007 | Bauer et al. | 361/611 |
| 7,446,635 | B2 * | 11/2008 | Stanke et al. | 335/160 |
| 2010/0075521 | A1 * | 3/2010 | Hsieh et al. | 439/226 |
| 2010/0112843 | A1 * | 5/2010 | Heichal et al. | 439/299 |

FOREIGN PATENT DOCUMENTS

| | | | |
|---|---|---|---|
| EP | 0514295 | A1 | 11/1992 |
| EP | 0588712 | A1 | 3/1994 |
| EP | 0869596 | A1 | 10/1998 |
| EP | 1837887 | A1 | 9/2007 |
| WO | WO 2005043685 | A2 | 5/2005 |

* cited by examiner

CONNECTING ELEMENT FOR THE CONNECTION OF SWITCHING DEVICES

PRIORITY STATEMENT

This application is the national phase under 35 U.S.C. §371 of PCT International Application No. PCT/EP2007/002459 which has an International filing date of Mar. 20, 2007, which designated the United States of America, the entire contents of which are hereby incorporated herein by reference.

FIELD

At least one embodiment of the invention generally relates to a connecting element for the connection of at least two switching devices. At least one embodiment of the invention also generally relates to a switching device and/or an electrical distribution system.

BACKGROUND

A connecting element is deployed wherever at least two electromechanical devices (switching devices) are to be connected electrically and mechanically to one another.

In one solution, as described in U.S. Pat. No. 6,663,441, the devices are connected mechanically in a direct manner by way of guide grooves. The electrical connection is then subsequently effected by way of a separate three-pole plug.

In a further solution (Moeller GmbH, "xStart: effiziente Lösungen für den Motorabgang" (xStart: efficient solutions for the motor feeder), art. no. 284764, 2005) the switching devices are connected mechanically by way of an intermediate plate. The intermediate plate is attached to the circuit breaker and connected electrically to the circuit breaker. The electrical connection between the intermediate plate and the contactor is in turn effected by way of a three-pole plug.

SUMMARY

At least one embodiment of the invention allows rapid and wireless connection of a number of electromechanical devices.

At least one embodiment is directed to a connecting element for the connection of at least two switching devices, the connecting element having first means for the mechanical connection of the switching devices to one another and second means for the electrical connection of switching poles of the switching devices, the second means having flexibly configured coupling elements for coupling to coupling means of the switching devices connected electrically to the switching poles.

The inventive connecting element of at least one embodiment (plug-in connector) allows mechanical and electrical connection of the switching devices without wires. When devices are connected, their tolerances have to be taken into account. Manufacturing deviations at the couplings (due to the production process) can cause minimal deviations in the positions of the couplings. These deviations have to be compensated for by a suitable coupling element (plug). With at least one embodiment of the inventive solution this is achieved by the flexible embodiment of the coupling elements, with the result that these can engage in contact openings of the coupling element of the switching devices and bend outward. The flexible embodiment thus allows each coupling element to be bent per se—independently of one another—thereby compensating for tolerances.

It is also possible with at least one embodiment of the inventive connecting element to halve the high insertion forces, in that the plug-in connector is first attached to a switching device, e.g. a contactor, and then the plug-in connector and the contactor are attached to another switching device, e.g. a circuit breaker. Since both the mechanical connection and the electrical connection are achieved with one plug-in connector, the number of connecting parts required is reduced. Also only one connecting process is necessary to contact the coupling element of the switching devices and to create a mechanical connection.

In one advantageous form of the embodiment the coupling elements are configured as conductive pins. These so-called pins are provided to engage in the contact openings of the switching devices. In a typical embodiment the connecting element has three pins for each switching device to be connected, it being possible for these also to be realized as connected male multipoint connectors, making it extremely suitable in particular for standard switching devices such as circuit breakers and contactors.

In a further advantageous embodiment, the conductive pins have a plastic sheathing. This improves safety in particular in situations where the plug-in connector is only connected to one switching device and the coupling elements not yet connected to a switching device are connected to power-carrying lines.

In a further advantageous embodiment the plastic sheathing is configured in a flexible and/or finger-shaped manner. This flexible plastic sheathing contributes to the flexibility of the coupling elements, with a finger-shaped configuration in particular allowing tolerance compensation in all three spatial directions.

In a further advantageous embodiment the coupling elements are configured in a finger-shaped manner such that they are flexible in all three spatial directions. This finger-shaped configuration increases flexibility even more, so that tolerances due to the production process can be compensated for even more easily.

In a further advantageous embodiment the coupling elements on a first side of the connecting element are shorter than those on a second side of the connecting element. This—in addition to the possibility mentioned above—allows the required insertion force to be reduced, allowing easier installation.

In a further advantageous embodiment the second devices/elements are configured to implement a reversing wiring or a series connection wiring with two switching devices disposed adjacent to one another. This allows such complicated wiring systems to be realized in a simple manner, saving a considerable amount of time.

In a further advantageous embodiment the first devices/elements have an intermediate element. This allows protection to be provided for the couplings between the switching devices against the egress of plasma and gas due to short circuits.

In a further advantageous embodiment the first devices/elements have guides, which can be used to guide the connecting element on guides on a housing of at least one of the switching devices to be connected. It is possible with these guides, which are preferably attached to the intermediate element, to implement contacting in a simpler manner. In particular mechanical guiding can provide better protection for the electrical contacting against bending or twisting, in other words more reliable insertion of small contact pins is also possible, as they are guided during insertion and lateral kinking is prevented. It is thus possible to use thinner and weaker and possibly also more favorable electrical conductors, for example in the form of male multipoint connectors, for electrical contacting.

Switching devices are advantageously used here with switching poles and coupling means connected electrically to these, embodied as plug-in terminals, a housing of the switching device having guides, by which the switching device can be guided on guides of a connecting element provided for the connection of at least two switching devices.

BRIEF DESCRIPTION OF THE DRAWINGS

The invention is described and explained in more detail below with reference to the example embodiments illustrated in the figures, in which.

DETAILED DESCRIPTION OF THE EXAMPLE EMBODIMENTS

Figure 1:
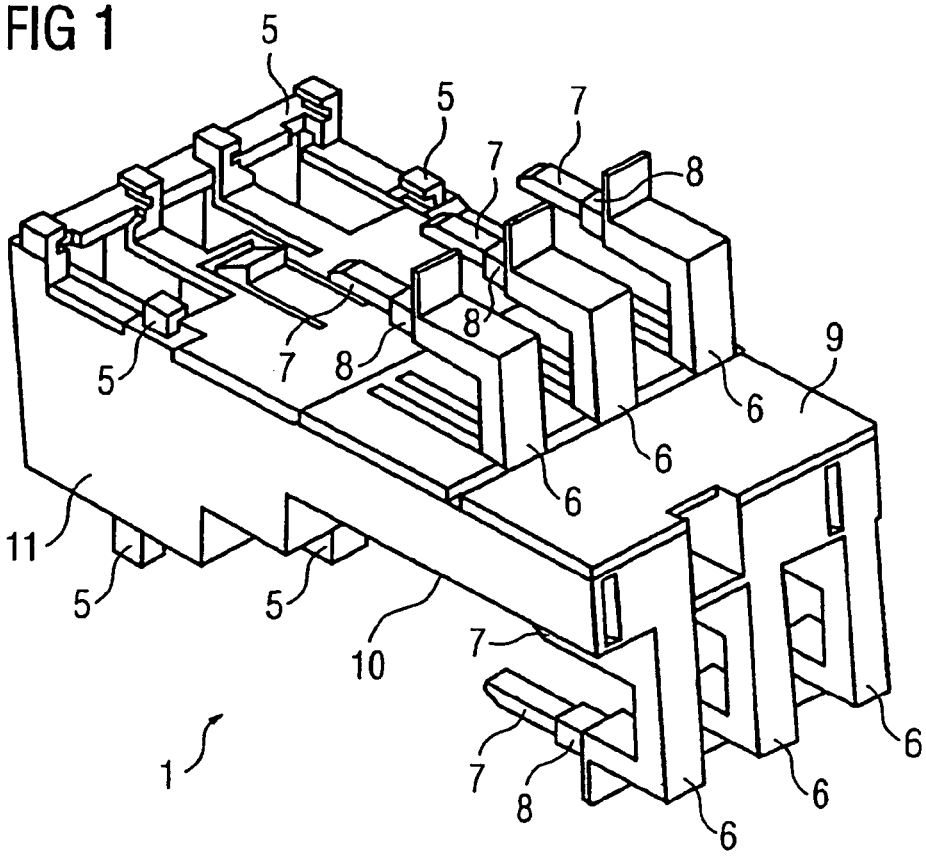
FIGS. 1-4 show different inventive connecting elements.

FIG. 1 shows a connecting element 1 for the mechanical and electrical connection of two different switching devices 13-15, for example for the connection of a contactor 13, 14 to a circuit breaker 15, see FIGS. 6-10. The connecting element 1 has first element(s)/device(s) 5 for the mechanical connection and second element(s)/device(s) 6 for the electrical connection of the switching devices 13-15. The first element(s)/device(s) 5 here are embodied partially as guides 12 (see FIG. 2), by which the connecting element 1 can be guided easily on corresponding guides on the switching device housing 18 (see FIG. 5), at the same time offering better protection for the electrical contacting against bending or twisting, since during insertion the guide prevents lateral kinking even of smaller contact pins 7. The first element(s)/device(s) 5 also have an intermediate element 11, which is configured so that a second switching device—for example a contactor 13, 14—is protected from blowout plasma of a first switching device—for example of a circuit breaker 15—as a result of a short circuit. This also allows a larger blowout space to remain present than when the switching devices 13-15 are plugged together directly.

The second element(s)/device(s) 6 include the coupling elements 7, so-called pins, with a plastic sheathing 8, of which three are attached respectively to a first side 9 and a second side 10 of the connecting element 1. These pins 7 can each achieve tolerance compensation per se and independently of one another. The finger-shaped configuration of the pins 7 ensures a high level of flexibility in all three spatial directions. The plastic sheathing 8, which encloses the coupling elements 7 respectively, is configured like these in a flexible and finger-shaped manner—thus enclosing the conductive pins 7 up to the intermediate element 11—so that tolerance compensation can be achieved easily by way of the pins 7 and plastic sheathing 8 in all three spatial directions. The coupling elements 7 are made of an electrically highly conductive material.

Figure 2:
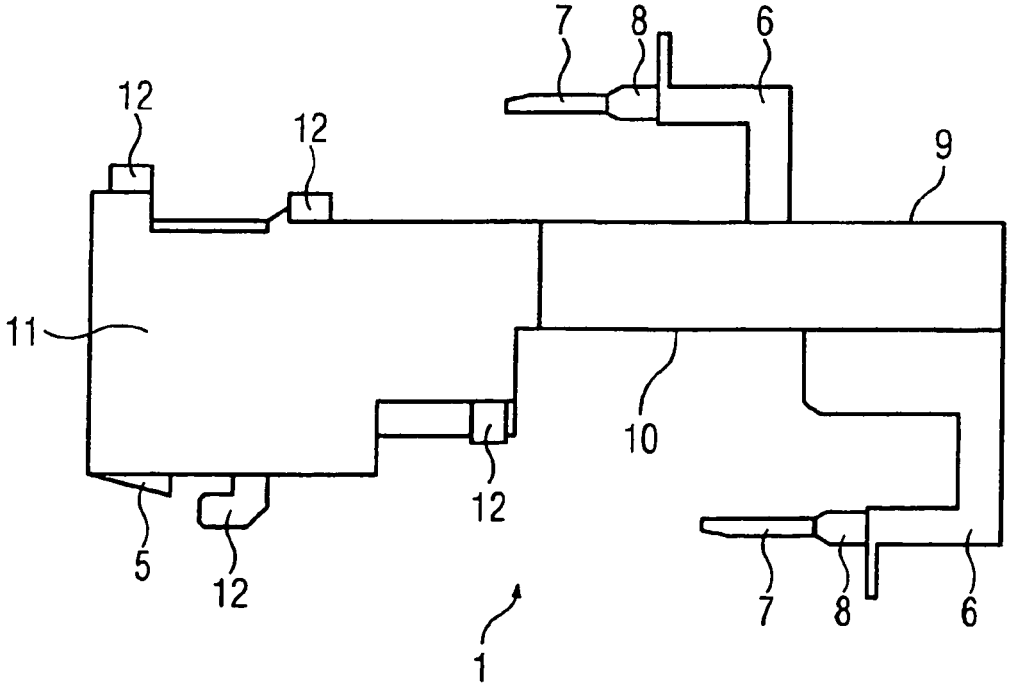

FIG. 2 shows the connecting element 1 from FIG. 1 in cross section, so that the guides 12 and the plastic-sheathed coupling elements 7, 8 in particular can be identified more clearly. See FIG. 1 for an explanation of the further reference characters.

Figure 3:
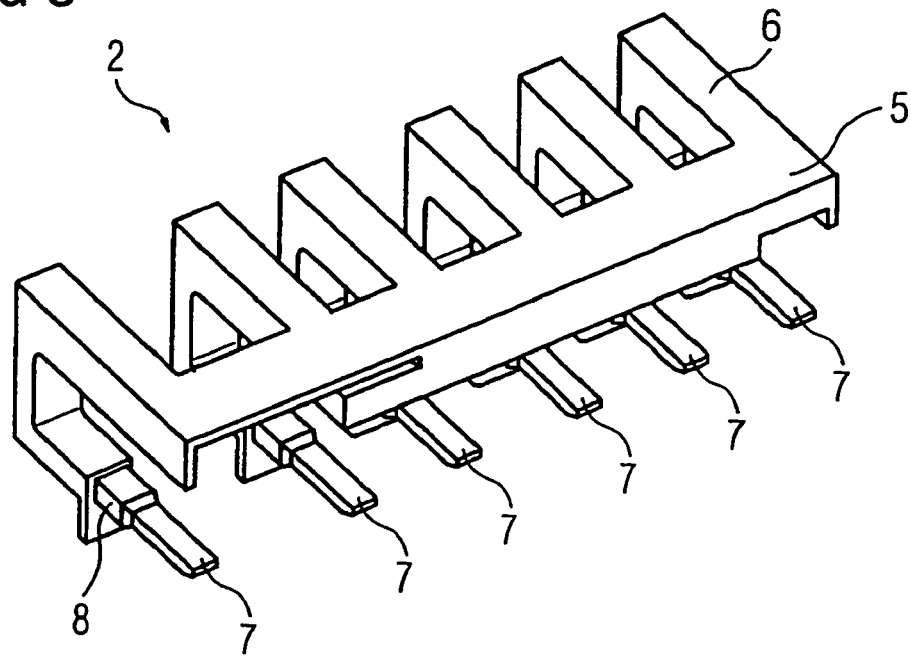
Figure 4:
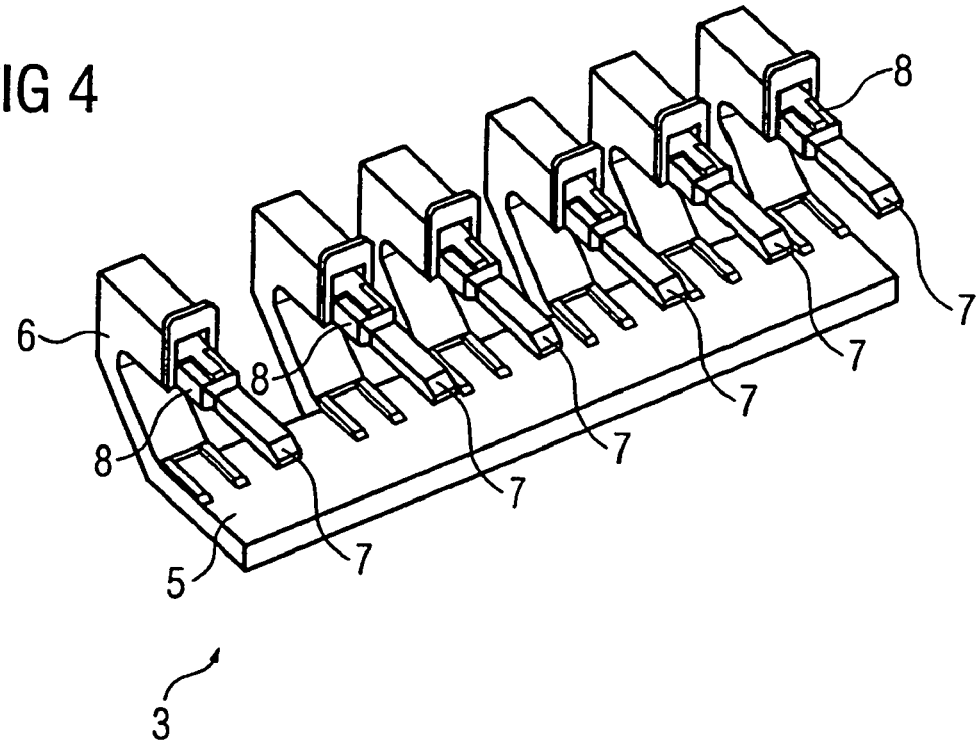

FIGS. 3 and 4 shows two further embodiments of connecting elements 2, 3 for the connection of switching devices 13-15. With these embodiments first element(s)/device(s) 5 and second element(s)/device(s) 6 are virtually interwoven. The respective coupling elements 7 with the plastic sheathing 8 (pins) are likewise configured as finger-shaped again and thus in turn ensure simple tolerance compensation independently of one another in all three spatial directions.

Figure 5:
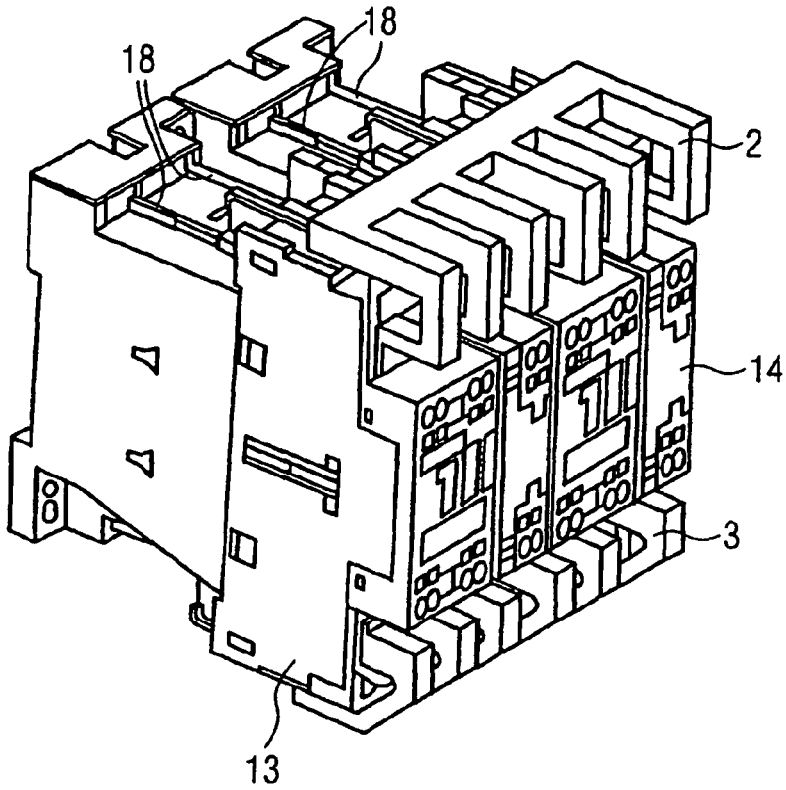
FIG. 5 shows two switching devices connected to connecting elements.

FIG. 5 shows two adjacent switching devices 13, 14—for example two contactors—which are connected mechanically and electrically to one another by means of the connecting elements 2, 3, with the mechanical and electrical connection being established in one operation. The electrical connection is established directly from the first switching device 13 to the second switching device 14. Guides on the switching device housing 18 serve to guide a connecting element 1 during insertion, as shown in FIGS. 1 and 2.

Figure 6:
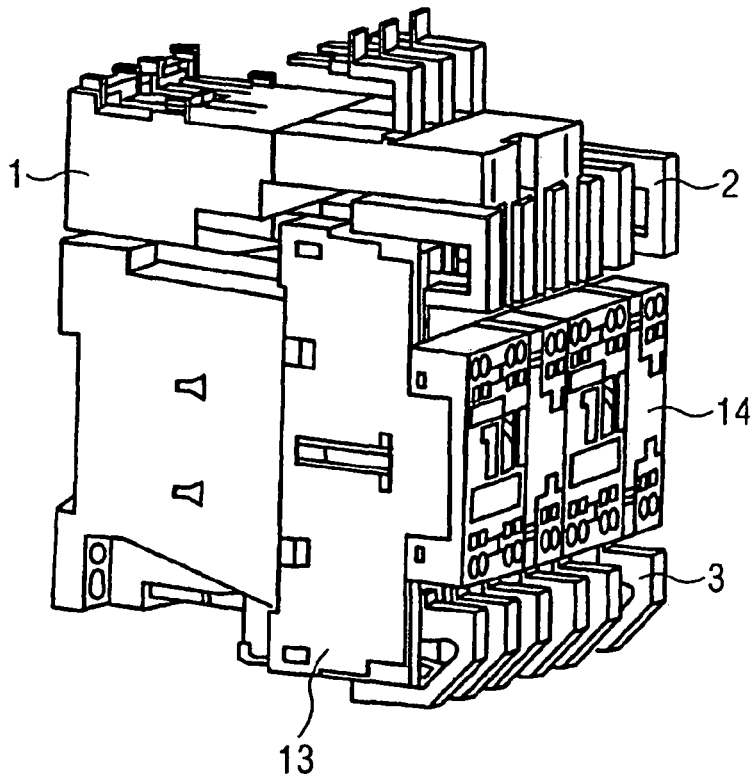
FIGS. 6-7 show the combination from FIG. 5 with a further connecting element.

FIG. 6 shows the switching devices 13, 14 from FIG. 5 connected to the connecting elements 2, 3, with a connecting element 1, as shown in FIGS. 1 and 2, attached to the left-hand switching device 13 in the diagram. The connecting elements 1 and 2 are thus embodied in such a manner that they engage in one another easily, with the result that the switching device 13 can be connected both to the switching device 14 adjacent to it and to a further switching device to be attached by way of it.

Figure 7:
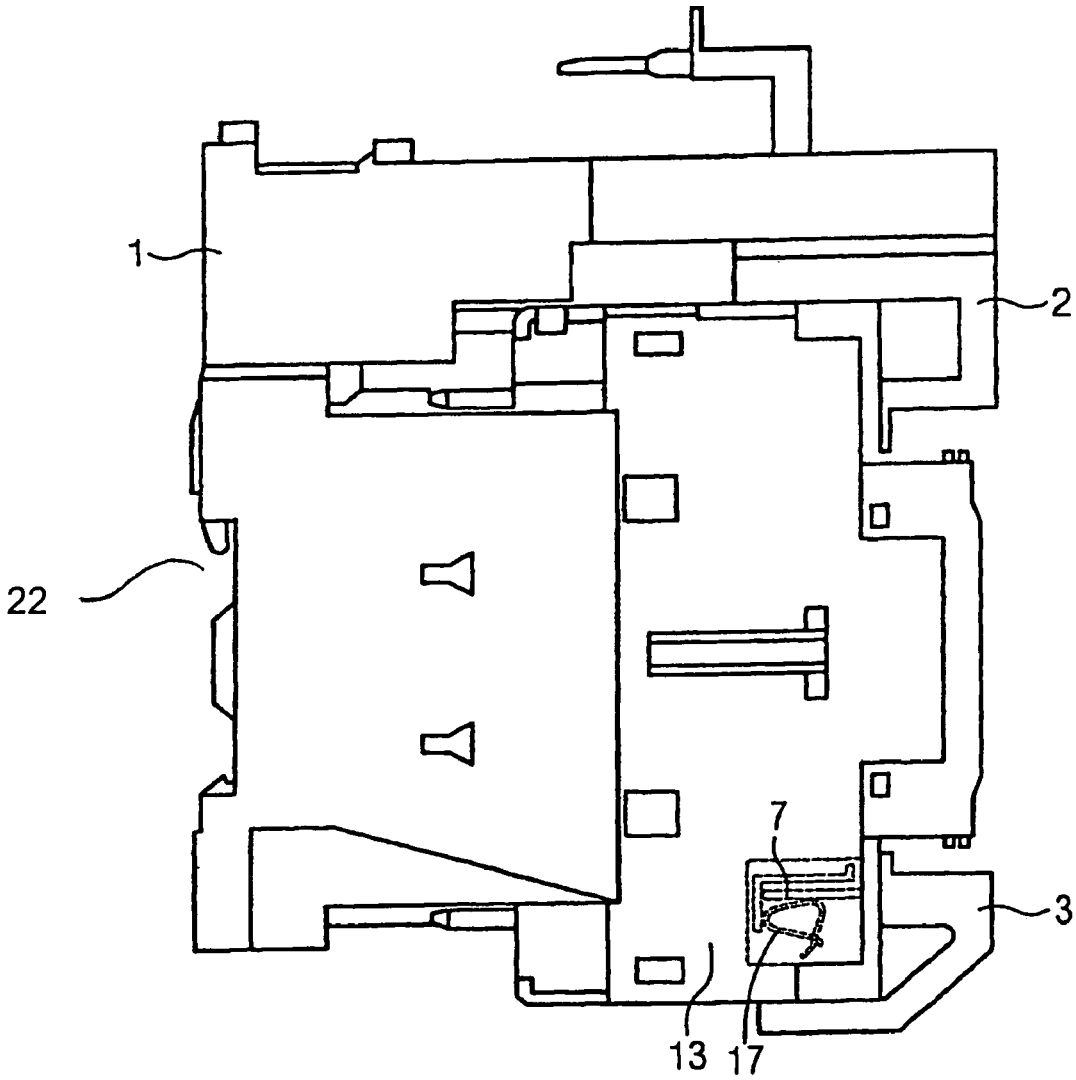

FIG. 7 shows the switching device combination 13, 14 with the connecting elements 1-3 from FIG. 6 in cross section and a top hat rail connection 22. A coupling element/device 17 of the switching device 13 and a coupling element 7 of the connecting element 3, which are connected electrically to one another, are also shown with a broken line in the bottom right-hand corner of the switching device 13. The coupling element/device 17 here is advantageously embodied as a plug-in terminal, thereby allowing simple and tool-less connection.

Figure 8:
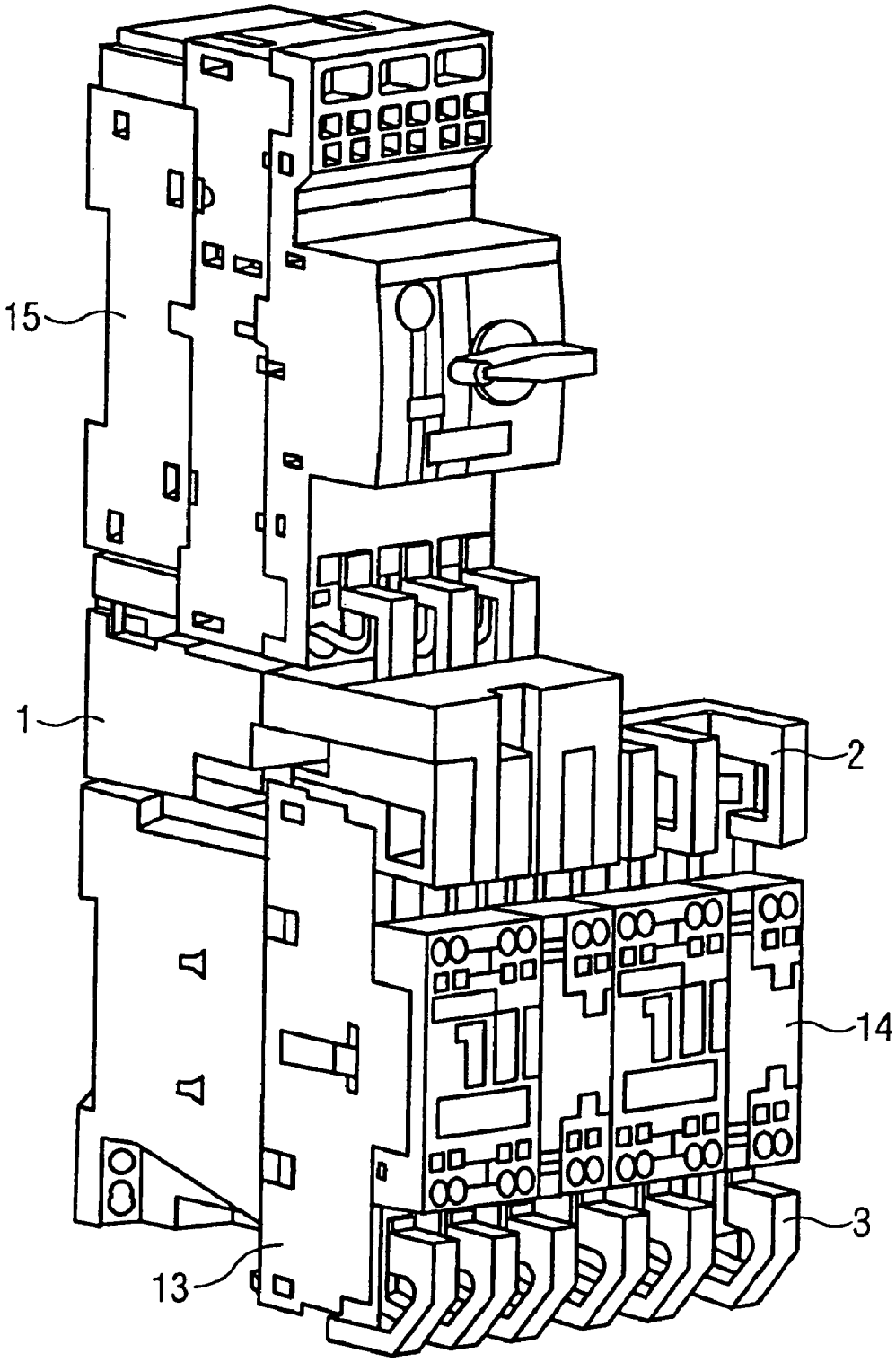
FIGS. 8-9 show the combination of the two previous figures, connected to a third switching device.
Figure 9:
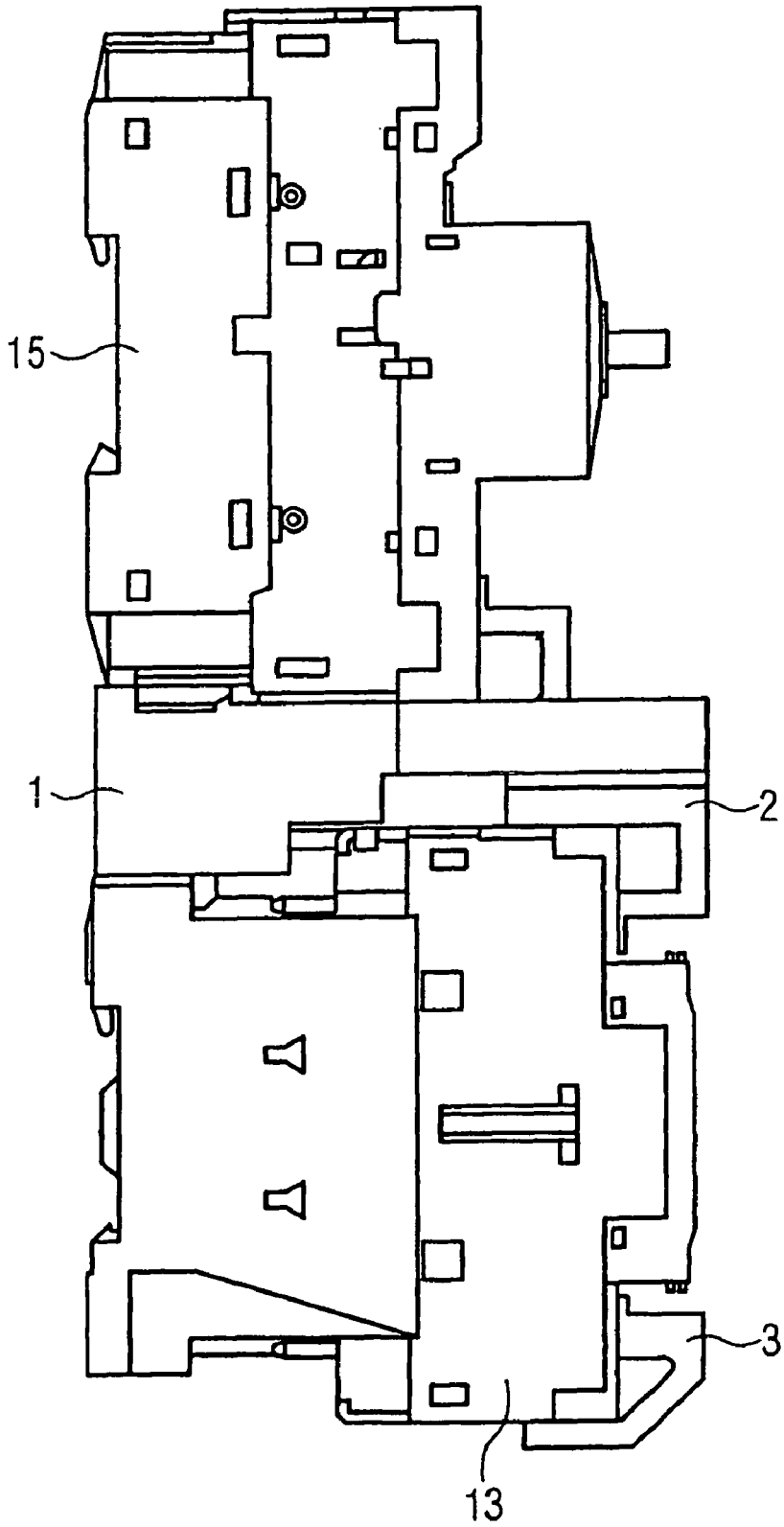

FIGS. 8 and 9 show the connecting element/switching device combination 1-3, 13, 14 from FIGS. 6 and 7, with the switching device 13 being connected by way of the connecting element 1 to a further switching device 15—for example a circuit breaker. The diagrams are again both perspective (FIG. 8) and cross-sectional (FIG. 9).

Figure 10:
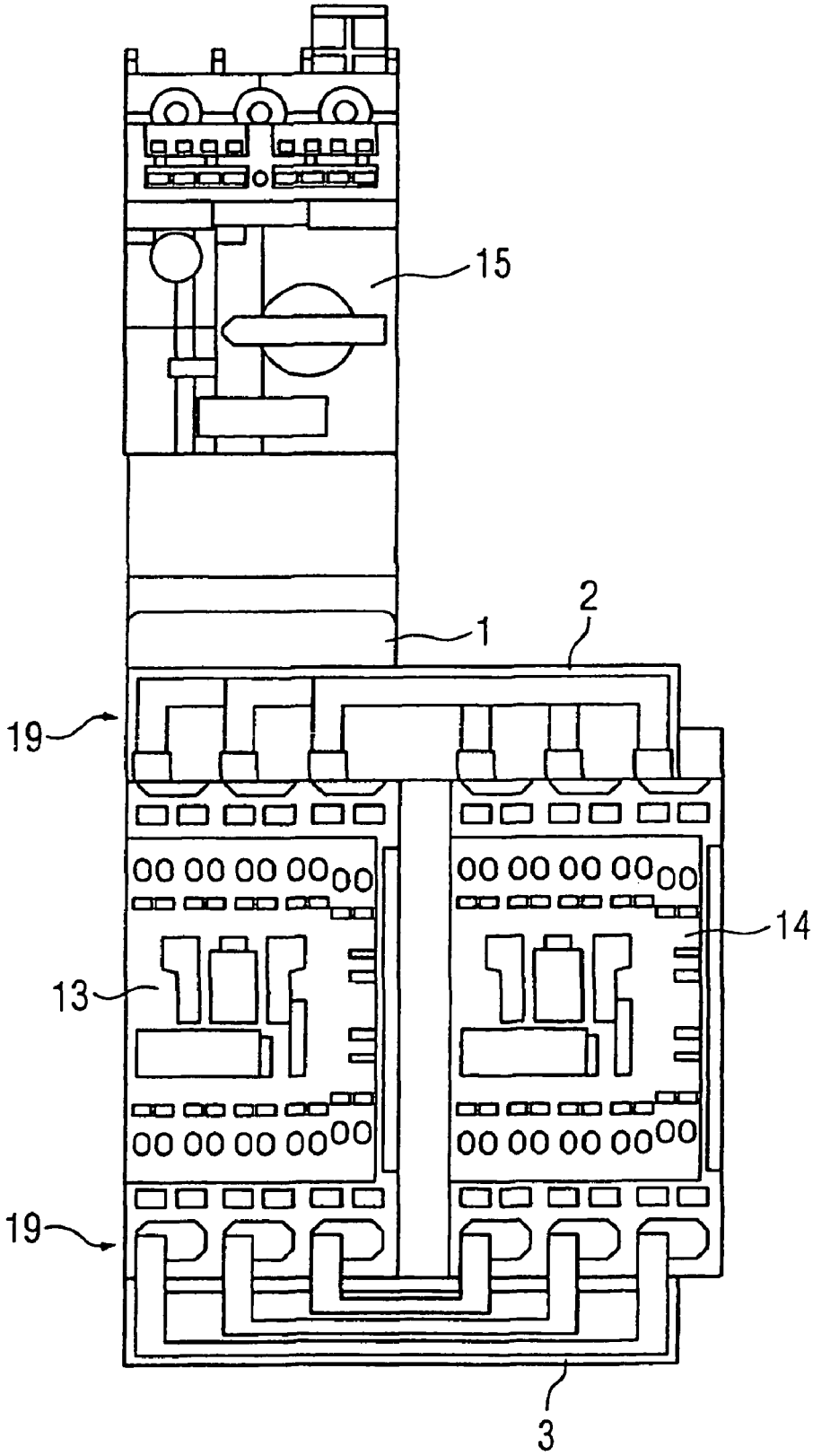
FIG. 10 shows a schematic diagram of the combination of the two previous figures, in which the wiring of the two switching devices first connected can be seen.

FIG. 10 shows a schematic diagram of the connecting element/switching device combination 1-3, 13-15 from FIGS. 8 and 9, in which the wiring of the two switching devices 13, 14 first connected can be identified. The wiring shown is reversing wiring 19, in which two contactors 13, 14 are connected adjacent to one another and in a parallel manner to plug-in connectors 2, 3.

Figure 11:
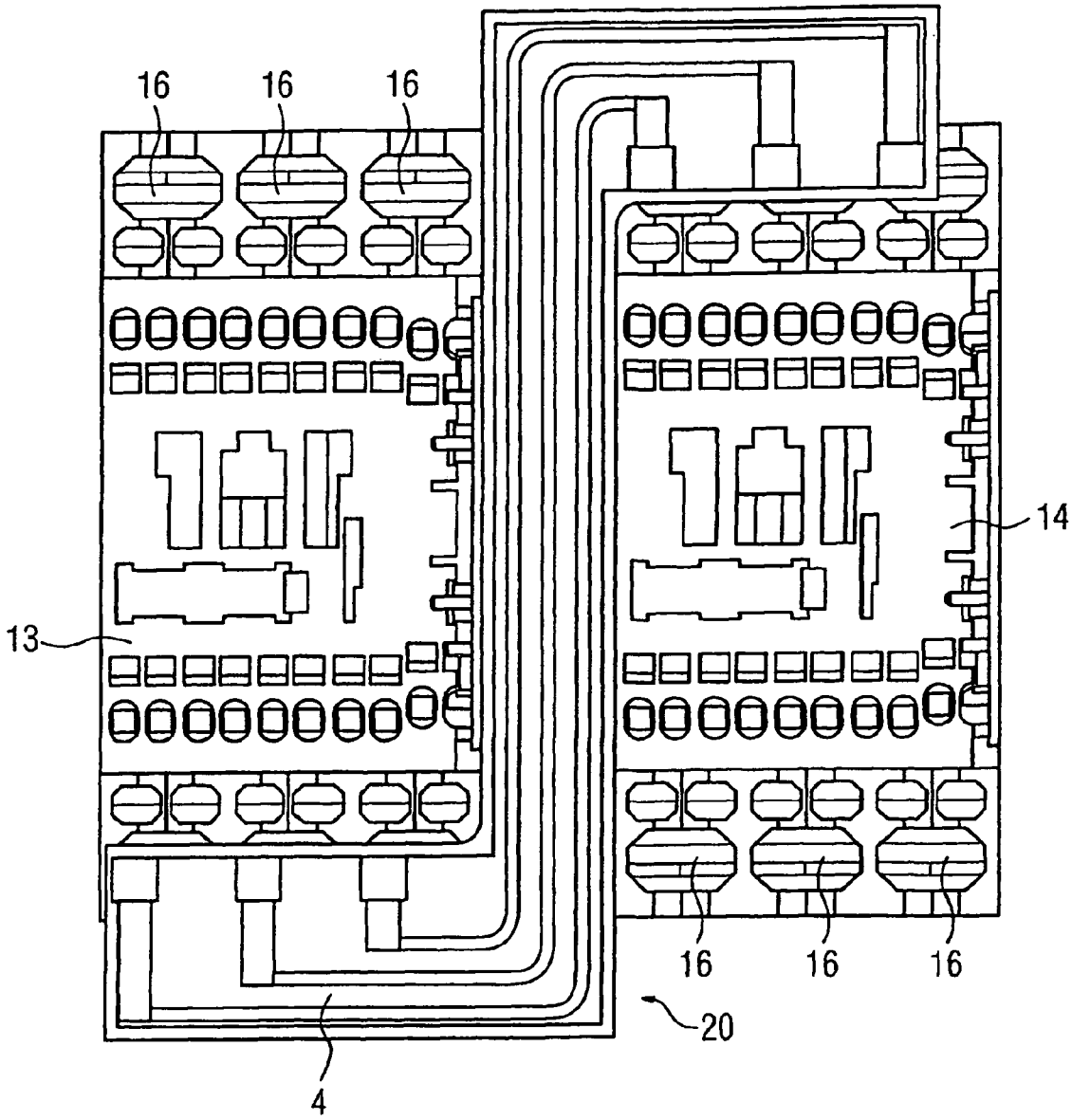
FIG. 11 shows a schematic diagram of two switching devices connected to a further connecting element.

FIG. 11 shows a schematic diagram of two switching devices 13, 14 connected to a further connecting element 4, with a series connection wiring 20 being realized by way of the connecting element 4, in which two contactors 13, 14 are connected adjacent to one another and in series to plug-in connectors 4. Like the connecting elements 1-3 the connecting element 4 here is embodied with plastic-sheathed coupling elements 7, 8 (pins), which allow the required tolerance compensation. The switching poles 16 of the switching devices 13, 14 can also be clearly identified in this figure.

The switching devices 13-15 to be connected are configured to switch a multiphase power circuit. One of the switching devices 15 here can be configured as a protection device, in other words to protect against overload and/or short circuit, and the other switching devices 13, 14 for operational switching. In one particularly favorable embodiment the switching devices 13-15 are embodied as low-voltage switching devices, which can be realized for example as mechanical, electromechanical or electronic switching devices. Both protection devices 15 and switching devices for operational switching 13, 14 are frequently connected in a power circuit. Since these types of connection can be implemented in large numbers, a great deal of time can be saved with the method and connecting elements 1-4.

To summarize, at least one embodiment of the invention relates to a connecting element for the connection of at least two switching devices as well as a switching device and an electrical distribution system. To allow rapid and wireless connection of a number of electromechanical devices, a connecting element is proposed for the connection of at least two switching devices, the connecting element having first element(s)/device(s) for the mechanical connection of the switching devices to one another and second element(s)/device(s) for the electrical connection of switching poles of the switching devices, the second means having flexibly configured coupling elements for coupling to coupling element(s)/device(s) of the switching devices connected electrically to the switching poles.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A connecting element for the connection of at least two switching devices, the connecting element comprising:

a plurality of first elements that mechanically connect the switching devices to one another; and a plurality of second elements that electrically connect switching poles of the switching devices, the second elements including flexible finger-shaped coupling elements, having a first portion extending from a surface of the connecting element and a second portion orthogonal to the first portion, for coupling to coupling elements of the switching devices connected electrically to the switching poles, wherein the flexible finger-shaped coupling elements include conductive pins extending from the second portion that are flexible in all spatial directions and have a plastic sheathing and wherein the second elements are configured to connect switching poles of switching devices electrically to one another by insertion and, wherein the flexible finger-shaped coupling elements on a first side of the connecting element are shorter than those on a second side of the connecting element.

2. The connecting element as claimed in claim 1, wherein the plastic sheathing is configured in at least one of a flexible and finger-shaped manner.

3. The connecting element as claimed in claim 1, wherein the second elements are configured to implement at least one of a reversing wiring and a series connection wiring with two switching devices disposed adjacent to one another.

4. The connecting element as claimed in claim 1, wherein the first elements include an intermediate element configured to protect at least one of the switching devices from blowout plasma.

5. The connecting element as claimed in claim 1, wherein the first elements include a guide portion that guides the connecting element on corresponding guides on a housing of at least one of the switching devices to be connected.

6. The connecting element as claimed in claim 1, wherein the second elements are bent in such a manner that they point in the same direction.

7. An electrical distribution system including at least two switching devices, each switching device including switching poles and coupling elements connected electrically to another of the at least two switching devices, embodied as plug-in terminals, a housing of the at least two switching devices including guides, by which the switching devices are guidable on guides of a connecting element provided for the connection of the at least two switching devices and with at least one connecting element as claimed in claim 1.

8. The electrical distribution system as claimed in claim 7, wherein the connecting element and the at least two switching devices are configured to bring about the electrical and mechanical connection by insertion in the direction of a top hat rail connection of the switching devices.

9. An electrical distribution system including at least two switching devices and including at least one connecting element as claimed in claim 1.

10. A switching device comprising:

switching poles and coupling elements, embodied as plug-in terminals; and a housing of the switching device including guides, by which the switching device is guidable on guides of a connecting element including flexible finger-shaped coupling elements having a first portion extending from a surface of the connecting element and a second portion orthogonal to the first portion, the connecting element being provided for the connection of at least two switching devices, and wherein the conductive pins on a first side of the connecting element are shorter than those on a second side of the connecting element.

11. A connecting element for the connection of at least two switching devices, the connecting element comprising:

first elements to mechanically connect the switching devices to one another; and, a connecting element including flexible finger-shaped coupling elements having a first portion extending from a surface of the connecting element and a second portion orthogonal to the first portion, and wherein the flexible finger-shaped coupling elements includes conductive pins to electrically connect switching poles of the switching devices to one another by insertion, the conductive pins being flexible in all spatial directions and including a plastic sheathing, and wherein the conductive pins on a first side of the connecting element are shorter than those on a second side of the connecting element.

12. The connecting element as claimed in claim 11, wherein the plastic sheathing is configured in at least one of a flexible and finger-shaped manner.

13. The connecting element as claimed in claim 11, wherein the conductive pins are configured to implement at least one of a reversing wiring and a series connection wiring with two switching devices disposed adjacent to one another.

14. The connecting element as claimed in claim 11, wherein the first elements include an intermediate element.

15. The connecting element as claimed in claim 11, wherein the first elements include guides to guide the connecting element on guides on a housing of at least one of the switching devices to be connected.

16. The connecting element as claimed in claim 11, wherein the conductive pins are bent in such a manner that they point in the same direction.

* * * * *